US006655665B2

(12) United States Patent
Magnani

(10) Patent No.: US 6,655,665 B2
(45) Date of Patent: Dec. 2, 2003

(54) PROCESS FOR ADJUSTING CARBURATION AND RELATED BOWL-TYPE CARBURETOR

(76) Inventor: George Magnani, 6859 Shoshone Ave., Van Nuys, CA (US) 91406

( * ) Notice: Subject to any disclaimer, the term of this patent is extended or adjusted under 35 U.S.C. 154(b) by 0 days.

(21) Appl. No.: 10/035,080

(22) Filed: Dec. 28, 2001

(65) Prior Publication Data

US 2003/0122267 A1 Jul. 3, 2003

(51) Int. Cl.[7] ..... F02M 19/04
(52) U.S. Cl. ..... 261/71; 261/DIG. 38
(58) Field of Search ..... 261/71, DIG. 38, 261/DIG. 39, DIG. 23

(56) References Cited

U.S. PATENT DOCUMENTS 1,272,036 A * 7/1918 Greuter ..... 261/71
1,464,601 A * 8/1923 Fairchild ..... 137/636.4
1,524,865 A * 2/1925 Hughes ..... 251/257
2,376,991 A * 5/1945 Eckenberg ..... 261/41.4
2,627,395 A * 2/1953 Rivoche ..... 261/40
3,414,244 A * 12/1968 Patterson, Jr. ..... 261/41.5
3,469,084 A * 9/1969 Du Bois ..... 261/71
3,484,084 A * 12/1969 Simpson et al. ..... 261/41.5
4,094,932 A * 6/1978 Knox, Sr. ..... 261/41.5
4,271,095 A * 6/1981 Maeda ..... 261/41.5
4,273,730 A * 6/1981 Byrnes, Jr. ..... 261/41.5
4,333,886 A * 6/1982 Mitsui ..... 261/18.3
5,249,773 A * 10/1993 Feld ..... 251/129.11

* cited by examiner

*Primary Examiner*—Richard L. Chiesa
(74) *Attorney, Agent, or Firm*—Kelly Bauersfeld Lowry & Kelley, LLP

(57) ABSTRACT

A process for adjusting carburation in a bowl-type carburetor having a main fuel jet for directing fuel to be mixed with air includes moving a needle into and away from the main fuel jet orifice. The needle is threadably inserted through a bowl plug of the carburetor, and moved into and away from the main fuel jet orifice by manually actuating a knob operably associated with an end of the needle extending from the carburetor, allowing the adjustment of carburation without carburetor disassembly, and even while the vehicle is moving.

8 Claims, 3 Drawing Sheets

PROCESS FOR ADJUSTING CARBURATION AND RELATED BOWL-TYPE CARBURETOR

BACKGROUND OF THE INVENTION

The present invention relates to the field of two and four stroke engine and carburetor tuning. More particularly, the present invention relates to an improved bowl-type carburetor which permits the control of the amount of fuel that passes through a main jet thereof to adjust carburation.

In a two-stroke engine, the air to fuel ratio is critical to the engine's performance and must be mixed in proper proportions by weight. It is the function of the carburetor to supply the proper mixture to the engine under all operating conditions. If there is excess fuel, the engine will run rich and lose horsepower. Carbon deposits are also created which foul the spark plug, adversely affecting the performance of the engine and even shutting off the engine in extreme cases. On the other hand, insufficient fuel will make the engine run lean creating a high temperature condition in the combustion chambers of the engine causing a reduction in horsepower, detonation, possibly pre-ignition and even piston seizing. These problems can turn into expensive engine repairs.

Major functional systems of a carburetor are a float, a float valve mechanism which maintains a constant level of fuel in the bowl, a pilot system that supplies fuel at low speeds, and a main fuel system that supplies fuel at medium and high speeds. In a full throttle position, the main jet orifice determines how much fuel goes into the engine, and therefore its performance. The only way to adjust the mixture of a carburetor coming from the factory is to take the carburetor off the engine, disassemble the plug at the bottom of the bowl, change the main jet, reassemble the carburetor and prime it before its use again.

Typically, on a given race or ride day, the driver of a shifter kart or motorcycle must find the main jet setting that delivers the most power for the weather conditions. Carburation, especially in a two stroke engine, is very sensitive to weather conditions such as barometric pressure, temperature and humidity. Generally, in the morning the driver guesses what the setting of the main jet should be and makes a test run. After returning to the pit area, the spark plug is read to determine if the main jet selection was appropriate. A few trials may be needed to find the appropriate jetting. Even if the carburation was set properly during practice in the morning, if the races are held in the afternoon, the weather conditions may have changed, sometimes drastically. If there is less barometric pressure, the engine will run too rich and have less power. However, if there is an increase in barometric pressure, the engine will run too lean, losing power at first and perhaps seizing later. In either event, the kart or motorcycle will be slowed significantly or even taken out of the race completely due to engine failure.

Accordingly, there is a need for a bowl-type carburetor which can be modified without having to remove and adjust the settings thereof. What is also needed is a bowl-type carburetor which is not limited to pre-determined main jet sizes, but rather is adjustable while driving. The present invention fulfills these needs and provides other related advantages.

SUMMARY OF THE INVENTION

The present invention resides in a bowl-type carburetor having a main fuel jet for directing fuel to be mixed with air, which carburation can be adjusted and controlled without the need of disassembling the carburetor and changing the main fuel jet. In accordance with the present invention, this is accomplished by positioning an adjustable orifice plug generally opposite an inlet of an orifice of the main fuel jet. The orifice plug is moved towards and away from the inlet to alter the amount of fuel permitted to flow through the main fuel jet orifice.

Typically, the orifice plug comprises a needle movable into and away from the main fuel jet orifice for altering the amount of fuel permitted to flow therethrough. Preferably, the main fuel jet is modified to include an enlarged orifice for accepting the needle. The means for positioning the needle include threadably inserting the needle through a bowl plug of the carburetor so that the needle is in alignment with the main fuel jet orifice.

The means for moving the needle into and away from the main fuel jet orifice includes a manually actuated worm gear operably associated with an end of the needle extending from the carburetor. A crank block is rotatably connected to an exterior surface of the bowl plug and encases the portion of the worm gear engaged with an end of the needle extending outwardly from the carburetor. To move the needle into and away from the main fuel jet orifice, a rotatable knob, attached to the worm gear generally opposite the crank block, is turned to cause the needle to travel along internal threads of the bowl plug either into or away from the main fuel jet orifice, adjusting the carburation of the engine.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
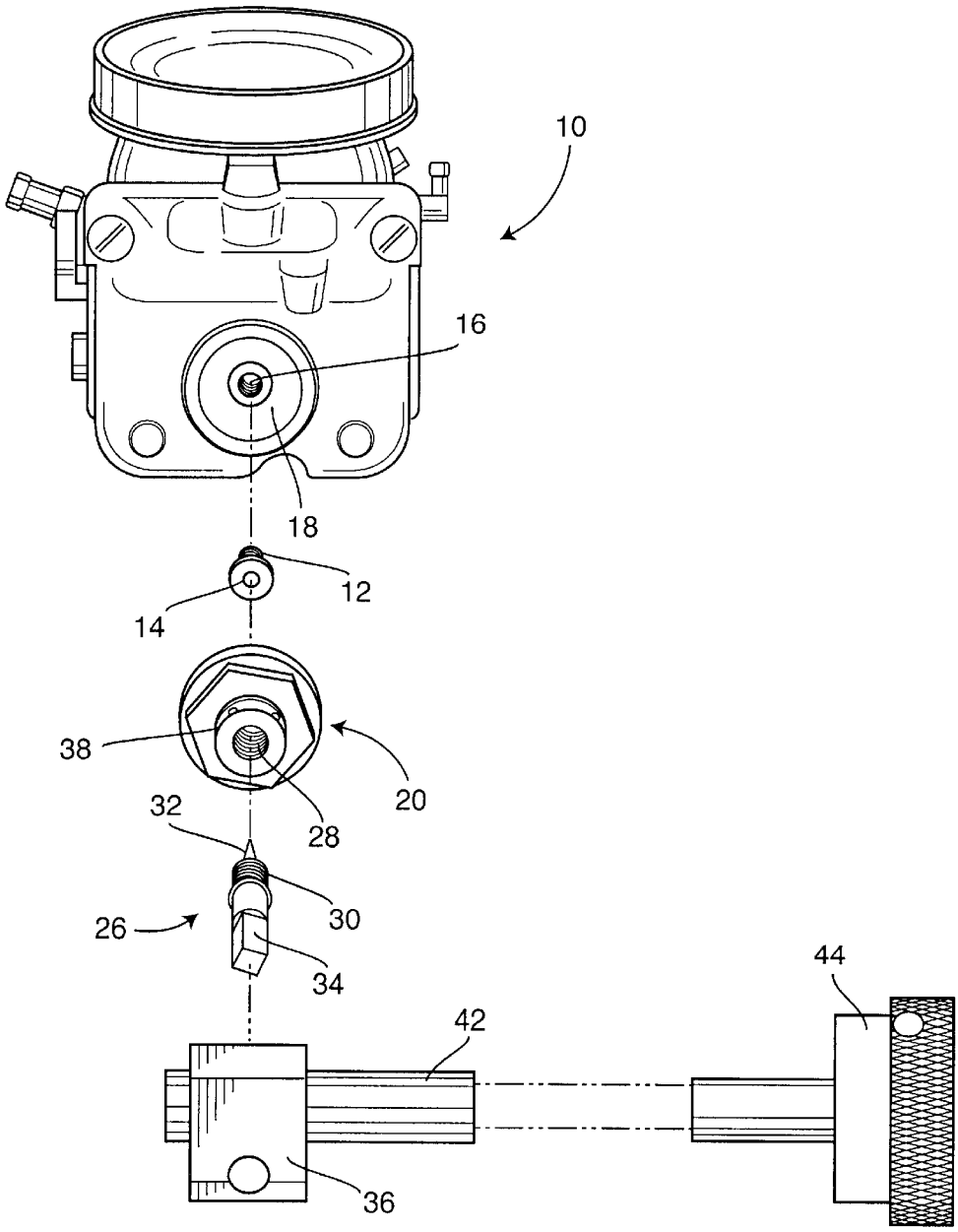
FIG. 1 is a perspective view of a bowl-type carburetor embodying the present invention, illustrating a main fuel jet, a bowl plug, a needle, and a needle positioning mechanism exploded therefrom.

As shown in the drawings for purposes of illustration, the present invention is concerned with a bowl-type carburetor, generally referred to by the reference number 10 which allows a person operating the vehicle, such as a shifter kart or motorcycle to adjust the carburation of the carburetor 10 without the need to disassemble the carburetor and replace a main fuel jet therein. The carburetor 10 is typical in practically every aspect with the exception that the main fuel jet 12 has an enlarged opening 14, or orifice therethrough. The main fuel jet 12 includes external threads for threadable insertion into a tube 16 within the carburetor 10 which channels the fuel to an airstream where it is mixed within the carburetor 10. The carburetor 10 includes a bowl 18 which holds an amount of fuel (illustrated as arrows in FIGS. 3 and 4), which fuel level is maintained constant with a float valve mechanism (not shown), all in standard fashion.

Figure 3:
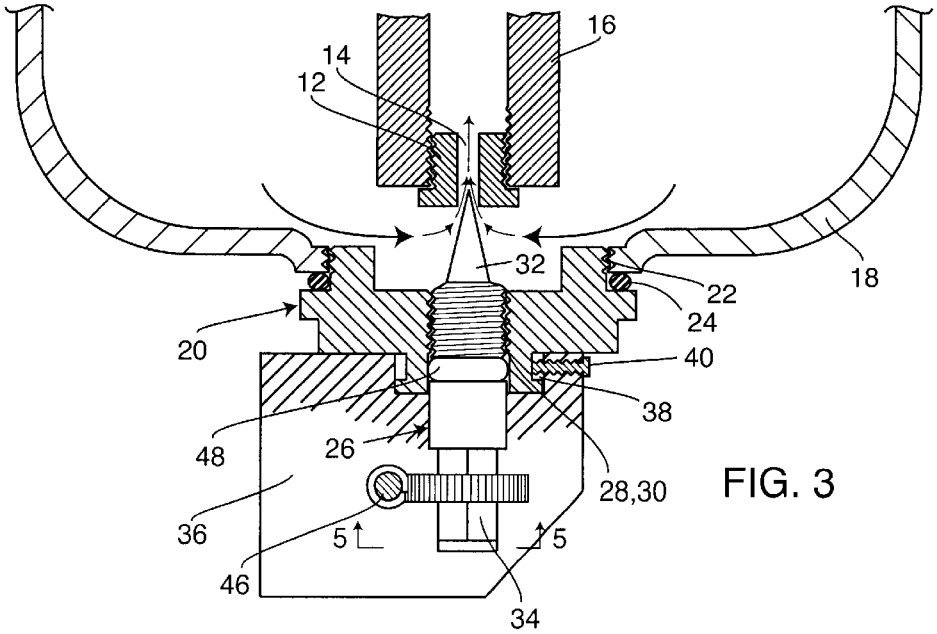
FIG. 3 is a fragmented cross-sectional view of the bowl-type carburetor of FIG. 1, illustrating the needle inserted into an orifice of the main fuel jet to limit the flow of fuel therethrough.
Figure 4:
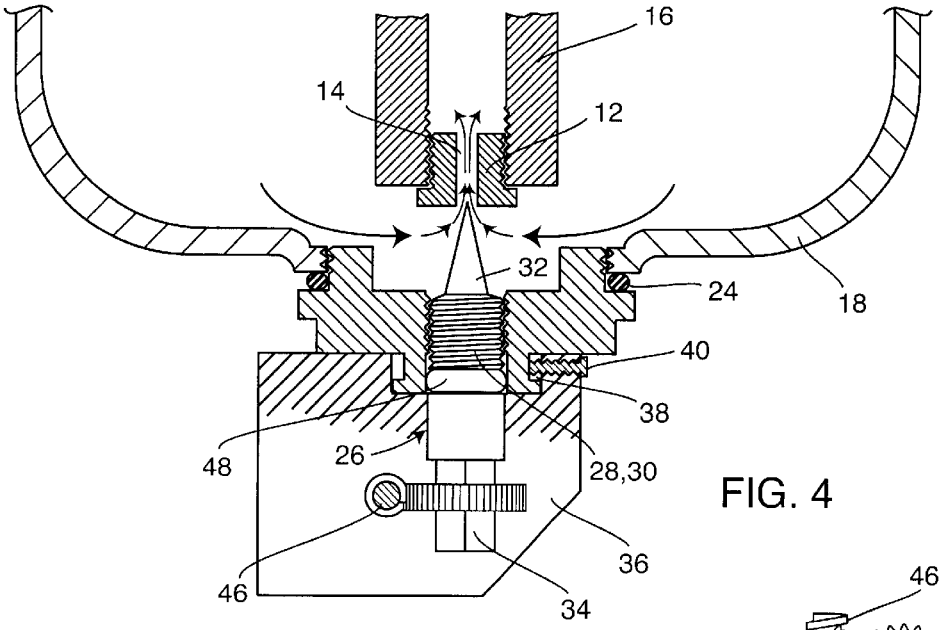
FIG. 4 is a cross-sectional view similar to that of FIG. 3, illustrating the needle removed from the orifice of the main fuel jet to allow more fuel to flow therethrough.

A new bowl plug 20 is installed in the bottom of the bowl 18, as illustrated in FIGS. 1 and 3, and 4. The bowl plug 20 is threadably received into bowl 18 by external threads 22, until an O-ring gasket 24 or the like placed between the bowl plug 20 and carburetor 10 is sufficiently compressed to prevent the leakage of fuel from the connection thereof. The bowl plug 20 is much thicker at a bottom portion thereof to accommodate an orifice plug 26, in the form of an adjustable needle. The bowl plug 20 includes internal threads 28 which accept a threaded portion 30 of the needle 26 so that the needle 26 can be selectively introduced through the bowl plug 20 and into the bowl 18.

Figure 5:
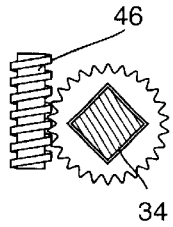
FIG. 5 is a top view of a worm gear and needle connection, enabling the adjustment of the needle height and carburation.

A plugging end of the needle 32 is typically conical in shape so as to substantially block the interior side walls of the main fuel jet orifice 14 when inserted thereon. An opposite end 34 of the needle 26 is multifaceted, such as a hex or the illustrated 4-sided end, so as to be received within a crank block 36 rotatably associated with the exterior end of the bowl plug 20. Typically, the exterior end of the bowl plug includes a groove 38 which receives a set screw 40 extending through the crank block 36, to form a rotatable connection. A tube 42 extends from the crank block 36 to a rotatable knob 44 and typically is placed within the driving compartment or within access to the rider of the vehicle. A worm gear 46 resides within the tube 42 and has an end operably connected to the needle end 34 within the crank block 36, such as by a gear encircling and engaged with the hex 34 as shown in FIGS. 3–5, and connected at the opposite end to knob 44 so that as the knob 44 is rotated, the worm gear 46 moves the needle 26 into and away from the main fuel jet orifice 14. The needle 26 preferably includes an O-ring 48 that saves to fluidly seal the needle 26 to the bowl plug 20. The crank block 36, worm gear 46, and knob 40 are collectively referred to in this application as a plug or needle positioning mechanism. It should be understood by the reader that this mechanism could be readily replaced by other mechanisms or means of moving the needle 26 into and away from the main fuel jet 12. However, it is believed that the illustrated positioning mechanism and threaded needle 26 are the preferred means of adjusting the carburation of the carburetor 10 as this design is simple to manufacture and operate.

Figure 2:
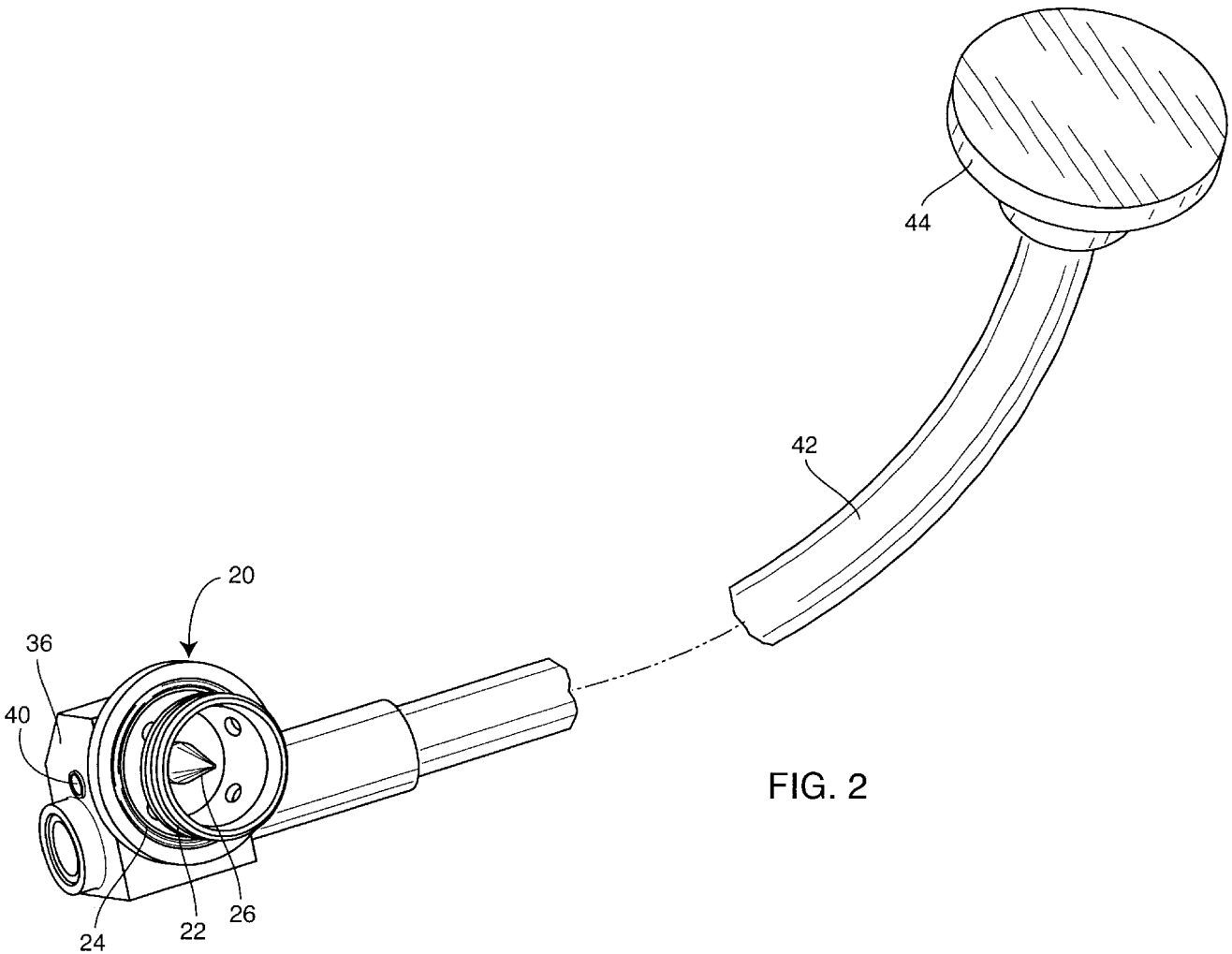
FIG. 2 is a partially fragmented perspective view of components used in accordance with the present invention for adjusting carburation in a bowl-type carburetor.

With reference to FIG. 2, it will be readily apparent to one skilled in the art that the main fuel jet 12, the bowl plug 20, the needle 26, and needle positioning mechanism could be provided as a retrofit kit to an existing carburetor. Preferably, the main fuel jet 12 is altered so that it has an enlarged orifice 14 for accepting the needle end 32 therein. Preferably, the tip of the needle 26 should be able to enter into the orifice 14 and extend therein a certain distance without completely blocking off the flow of fuel through the orifice 14. In this manner, the rate of flow of fuel can be adjusted from being completely unobstructed to various stages of obstruction, to completely obstructed by the needle 26. This allows the rider of the vehicle full adjustment capability of the carburation of the carburetor 10. Thus, the driver is able to adjust the air to flow ratio as many times as necessary while driving to obtain optimal performance during the race, or operation of the vehicle.

It will be readily seen that the invention improves the ability and accuracy and tuning of a bowl-type carburetor, without the need to disassemble and modify the carburetor or stop during the race to adjust the fuel flow jets. The invention eliminates the need to change the main jets before a race in an effort to guess which selection will best suit the needs for the weather conditions during the race. The invention allows the driver to select a richer mixture while breaking in an engine to improve lubrication and new components installed as well as allowing the driver to run parade laps with a leaner mixture and then richen the mixture at the start-of the race for optimum performance. The invention helps the environment as it eliminates the gas and oil spills caused by changing jets in the traditional manner. It will be readily apparent that the invention can make the difference between winning and losing a race due to the improvement in engine performance and time saved in fine tuning the engine. Also, the invention prevents engine damage due to the changing weather conditions throughout the race.

Although several embodiments of the present invention have been described in detail for purposes of illustration, various modifications of each may be made without departing from the spirit and scope of the invention. Accordingly, the invention is not to be limited, except as by the appended claims.

What is claimed is:

1. A process for adjusting carburation in a bowl-type carburetor having a main fuel jet for directing fuel to be mixed with air, comprising the steps of:

positioning an adjustable orifice plug generally opposite an inlet of an orifice of the main fuel jet, including threadably inserting a needle through a bowl plug of the carburetor and positioning the needle in alignment with the main fuel jet orifice; and moving the orifice plug towards and away from the inlet to alter the amount of fuel permitted to flow through the main fuel jet orifice.

2. The process of claim 1, wherein the moving step includes moving the needle into and away from the main fuel jet orifice.

3. The process of claim 2, wherein the moving step includes the steps of manually actuating a knob operably associated with an end of the needle extending from the carburetor.

4. A bowl-type carburetor, comprising:

means for positioning an adjustable orifice plug generally opposite an inlet of an orifice of a main fuel jet configured to direct fuel to be mixed with air; and means for moving the orifice plug towards and away from the inlet to alter the amount of fuel permitted to flow through the main fuel jet orifice;

wherein the positioning means includes a needle threadably inserted through a bowl plug of the carburetor so as to be in alignment with the main fuel jet orifice and movable into and away from the main fuel jet orifice.

5. The carburetor of claim 4, wherein the moving means includes a manually actuated knob operably associated with an end of the needle extending from the carburetor.

6. A bowl-type carburetor, comprising:

a main fuel jet having an orifice for directing fuel to be mixed with air;

an adjustable orifice plug positioned generally opposite the main fuel jet; and a plug positioning mechanism associated with the orifice plug, for actuating the orifice plug to selectively alter the amount of fuel permitted to flow through the main fuel jet orifice;

wherein the adjustable orifice plug comprises a needle movable into and away from the main fuel jet orifice for altering the amount of fuel permitted to flow therethrough; and wherein the needle travels along internal threads of a bowl plug of the carburetor into and away from the main fuel jet orifice as the plug positioning mechanism is actuated.

7. The carburetor of claim 6, wherein the plug positioning mechanism includes a worm gear interconnecting the needle and a rotatable knob.

8. The carburetor of claim 7, including a crank block associated with the worm gear generally opposite the knob and rotatably connected to an exterior surface of the bowl plug so as to be engaged with an end of the needle extending outwardly from the carburetor.

* * * * *